United States Patent [19]

Scalise

[11] Patent Number: 4,867,117

[45] Date of Patent: Sep. 19, 1989

[54] ROTARY VALVE WITH INTEGRATED COMBUSTION CHAMBER

[76] Inventor: Michael A. Scalise, 1300 N. 4th St., McAllen, Tex. 78502

[21] Appl. No.: 136,779

[22] Filed: Dec. 22, 1987

[51] Int. Cl.[4] ..... F01L 7/00

[52] U.S. Cl. ..... 123/190 BD; 123/80 BB; 123/80 D

[58] Field of Search ..... 123/190 A, 190 BD, 80 BB, 123/80 D, 80 DA

[56] References Cited

U.S. PATENT DOCUMENTS

| | | | |
|---|---|---|---|
| 3,130,953 | 4/1964 | Carpenter | 123/190 D |
| 3,893,483 | 7/1975 | Ackerman | 123/190 A |
| 3,896,781 | 7/1975 | Smith | 123/190 A |
| 3,945,364 | 3/1976 | Cook | 123/190 BD |
| 3,948,227 | 4/1976 | Guenther | 123/190 A |
| 4,036,184 | 7/1977 | Guenther | 123/190 A |

*Primary Examiner*—E. Rollins Cross
*Attorney, Agent, or Firm*—Thomas E. Sisson

[57] ABSTRACT

An internal combustion engine having a cylindrical rotary valve body positioned over each piston cylinder, and having a flow-passage chamber extending from the bottom of the valve body exposed to the piston chamber, and curved upward opening to the side of the valve body. The apparatus comprises a vertically rotating valve body positioned within a valve liner insert, and whose side aperture is disposed to make communication with the spark-plug cavity, the exhaust port, and the intake port, exposing the curved flow-passage to each function with fixed timing provided by the positions of the port apertures in the valve liner insert. Sealing is affected by compression rings and an aperture ring. Rotation of the valve body is provided by gear or chain linkage, and timed to the crankshaft.

6 Claims, 2 Drawing Sheets

ROTARY VALVE WITH INTEGRATED COMBUSTION CHAMBER

BACKGROUND

In the early 1900's several types of rotary valves were developed and used in both two-cycle and four cycle internal combustion engines. Most of these designs failed due to one or more of the following reasons: (a) High friction, (b) Lack of sufficient lubrication, (c) Thermal distortion, (d) Difficulty of manufacture.

The object of this invention is to reduce the problems associated with these prior-art valves and make use of the advantages of rotary valves in modern Internal Combustion Engines.

Another object of this invention is to provide an Internal Combustion Engine with increased volumetric efficiency resulting from unrestricted flow of gases through the ports, and the sling effect provided by centrifugal force of the spinning valve.

A futher object of this invention is to improve combustion by stratifying the fuel-air charge, by centrifugal force, into the spark-plug cavity.

A still further object of this invention is its ease of manufacture by eliminating the need for separate head and block. The valve is manufactured in its entirety as a separate unit and installed in the head or monoblock requiring only a cylindrical hole above each piston cylinder for a press fit.

The invention comprises a cylindrically shaped rotating valve body mounted vertically over each cylinder of a reciprocating internal combustion engine and driven by linkage to the engine crankshaft. The valve consists of a cylindrical body with an axially placed shaft extention above for attachment to rotating means and a curved flow passage chamber from the bottom of the valve with an opening concentric to it and exposed to the piston. The other end of the flow passage is positioned on the side of the cylindrical valve body forming an aperture which rotates about the cylinder axis and is disposed to communicate sequentially with corresponding apertures in the valve liner and engine head. Each valve liner aperture is timely exposed to the spark-plug cavity, the exhaust port and, the fuel-air inlet respectively.

On the upper circular end of the valve body a concentric depressed area is machined on the circumference leaving a boss area adjacent to the valve drive shaft, said boss area being in contact with a valve cap, and into which is contained a pressurized oil gallery extending from the boss area to outlets at all contact areas on valve surfaces. A return circuit gallery invention is provided for oil circulation and pressure regulation. The oil gallery openings on the boss area of the valve body are positioned to communicate with mating gallery openings in the valve cap providing a metered flow of oil the the valve each revolution. The concentric depressed area surrounding the boss area of the valve forms an enclosed volume between valve, valve cap and valve liner, said volume being vented to the flow passage chamber through a small hole for the purpose of equalizing the force on opposing ends of the valve body by causing the concentric depression area to be equal to transverse area of the flow passage chamber, thereby eliminating high friction pulses to occur at boss area against the valve cap.

Lubrication oil is metered into the valve body through the pressurized oil gallery in the valve cap and directed to the compression rings and to the the top and bottom horizontal faces of the flow passage chamber aperture seal, for lubrication of vertical ends of said seal, vertical groove are inscribed as required on the inside surface of the valve liner serving as oil pockets which dispense oil to the vertical surfaces of the flow chamber aperture seal.

The valve body is caused to turn at one-half crankshaft speed for four-cycle engine operation. It will be noted that the flow passage chamber aperture is theoretically in registry with only one valve liner aperture, at a given instant, excluding overlapping designed in a practical engine. Commencing with the firing stroke, the piston is moving upward compressing the fuel-air charge and the valve is approaching the spark-plug cavity. As the piston reaches top-dead-center, the flow passage chamber aperture exposes the spark-plug cavity. At top-dead-center the spark-plug is caused to fire forcing the piston downward. The flow passage chamber aperture rotates over the spark-plug cavity shielding the spark-plug from the combustion gases. As the piston approaches bottom-dead center the flow passage chamber aperture begins registry with the exhaust outlet port, said flow passage chamber aperture being in communication with exhaust outlet as the piston moves upward to top-dead-center. At top-dead-center, the flow passge chamber aperture begins registry with the charge inlet port in the valve liner. Moving down, the piston ingests the fuel-air charge as the flow passage chamber aperture rotates over the inlet port. The piston, passing bottom-dead-center, begins to compres the fuel-air charge as the flow passage chamber aperture has past the inlet port and is sealed against the valve liner side, again commencing the firing stroke. Examining the action of the spinning valve body beginning with the exhaust cycle, it is observed that the centrifugal force in the flow passage chamber will enhance the purging of the spent gases from the engine cylinder and flow passage chamber. The spent charge conducts some of its heat to the flow passage chamber as it passes through causing a rise in temperature of the valve body. Immediately following the exhaust cycle, the ingest of relatively cool fuel-air mixture through the same flow passage chamber now cools it tending to maintain a combustion chamber without hot-spots which cause pre-detonation. Reaching bottom-dead-center, the piston begins to rise initiating the compression stroke, the flow passage chamber aperture is out of communication with all open liner ports, and sealed against valve liner. As the piston rises it compresses the charge and forces it into the flow passage chamber. Note that the top of the piston approaches the bottom of the valve liner very closely. Nearly all of the fuel-air mixture is contained in the flow passage chamber and the spinning valve body causes the fuel vapor to stratify towards the valve liner. At top-dead-center the spark-plug cavity is exposed to the flow passage chamber aperture at which time the spark-plug fires igniting the fuel rich side of the charge. It is evident from the above that, (a) the spark-plug, being only monentarily exposed when the piston is in the firing position, and shielded from the fuel-air charge, cannot cause pre-detonation, (b) the stratification of the fuel vapor allows the flow passage chamber to function as a pre-combustion chamber with its inherent benefits of efficient burning. In addition, as the piston rises forcing the charge into the flow passage chamber, the differential areas of the piston top and the adjacent flow passage chamber opening breaks up any tendency for the formation of pressure nodes which normally cause pre-detonation in poppet valve engines. It is evident from the above that a low octane fuel can be used with this invention. The changing pressure differential imposed on the valve body is eliminated by the insertion of a small vent hole from the top of the flow passage chamber to the recessed area at the top of the valve body resulting in minimal friction losses between valve cap and boss area of the valve body. Sealing of the valve body is required about its cylindrical perifery to prevent leakage between combustion chamber and head ports.

This accomplished by two compression rings, one located at bottom valve body aperture and valve liner plate, and one located immediately below the upper recessed area of the valve body. It will be noted that the compression rings remain stationary with respect to the valve liner, the valve body grooves sliding over the rings. The circumferential flow passage chamber seal is recessed into the valve body and provides effective seal by pressure and centrifugal forces. The boss area on the valve body is maintained in contact with the valve cap by a spring and retainer screwed to the top of the valve shaft. Sealing is provided at the sliding faces of the rings as variations in pressure move the rings only the amount of clearance in the ring grooves. A bearing mounted concentrically in the valve cap maintains a predetermined clearance between valve body and valve liner. Lubrication is provided by a pressurized gallery extending through valve cap and in contact with the boss are of the valve body. The valve cap gallery outlet is in line with the valve body oil gallery said gallery extending vertically down through the valve body with outlets to rings and interior face of valve liner. A similar gallery is provided through valve body and valve cap to act as a pressure vent. The intake and exhaust timing is a function of the positions of the respective cylinder liner port apertures, these being fixed require no adjustments.

DESCRIPTION OF DRAWINGS

With reference to FIG. 1, there is shown a spark-ignition internal combustion engine of monoblock construction construction 24, into which is mounted a cylinder sleeve 29, for piston movement and above which is mounted the valve liner cylinder 9. The block is provided with one or more combustion cylinders, each of which has a piston 23, mounted there-in for reciprocal movement, each piston being connected in a conventional manner by a connecting rod to a crankshaft in the normal fashion of the art. Above each piston is mounted the rotary valve unit consisting of the valve liner 9, and the rotating valve body 13. The valve body 13, is confined in the valve liner by the cap plate 6, which is bolted to the block. The valve body drive shaft 30 passes through the cap plate 6, and held concentric to the valve liner 29, by means of a bearing 5. A bevel gear 3, is mounted on the drive shaft of the valve body 13, and secured by a retainer 1, and spring 2, exerting an upward force on the valve body providing a tight fit between the valve body boss area 22, and the valve cap plate 6. The bevel gear 3, is driven by a matching bevel gear 18, mounted at 90° to bevel gear 3. Bevel gear 18, is mounted on a transverse horizontal shaft 19, which in turn is rotated by conventional means by linkage to the engine crankshaft such that the valve body is disposed to rotate at one-half crankshaft speed, as viewed from above in this instance.

The motor block 24, is provided with an intake manifold passage 26, terminating at intake aperture in the valve liner cylinder, FIG. 4–26, timely registering with valve body side aperture to the flow passage chamber 14, for supplying fuel-air mixture to piston cylinder combustion chamber. Also contained in the motor block 24, is an exhaust passage, FIG. 2–25, timely registering with valve body side aperture to the flow passage chamber 14, for expelling the burnt fuel-air charge after combustion. These head passages are provided at each cylinder of a multi-cylinder engine.

Figure 2:
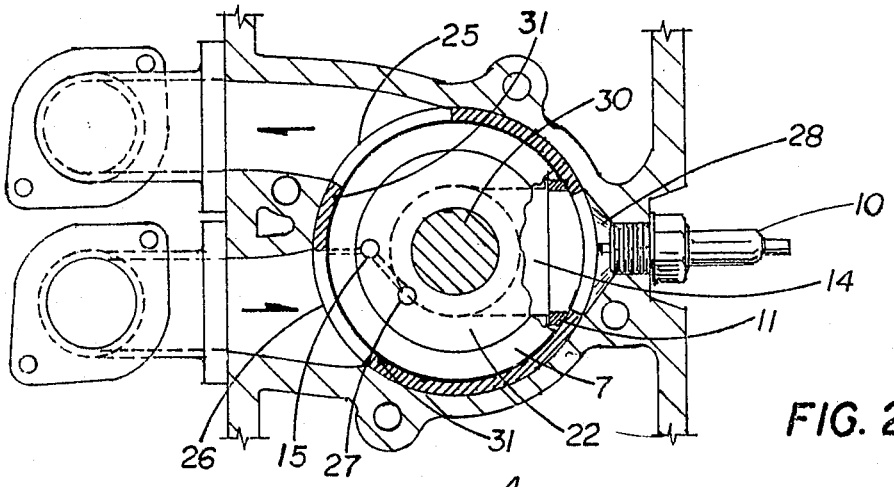
FIG. 2, is a horizontal cross-section view of the valve apparatus taken along the line 2—2 showing the relative positions of the spark-plug cavity, exhaust and inlet apertures, and head porting. Also shown are the oil galleries in the valve body, and a cut out through the front of the flow passage chamber and the sealing ring, showing a partial view of said chamber.
Figure 1:
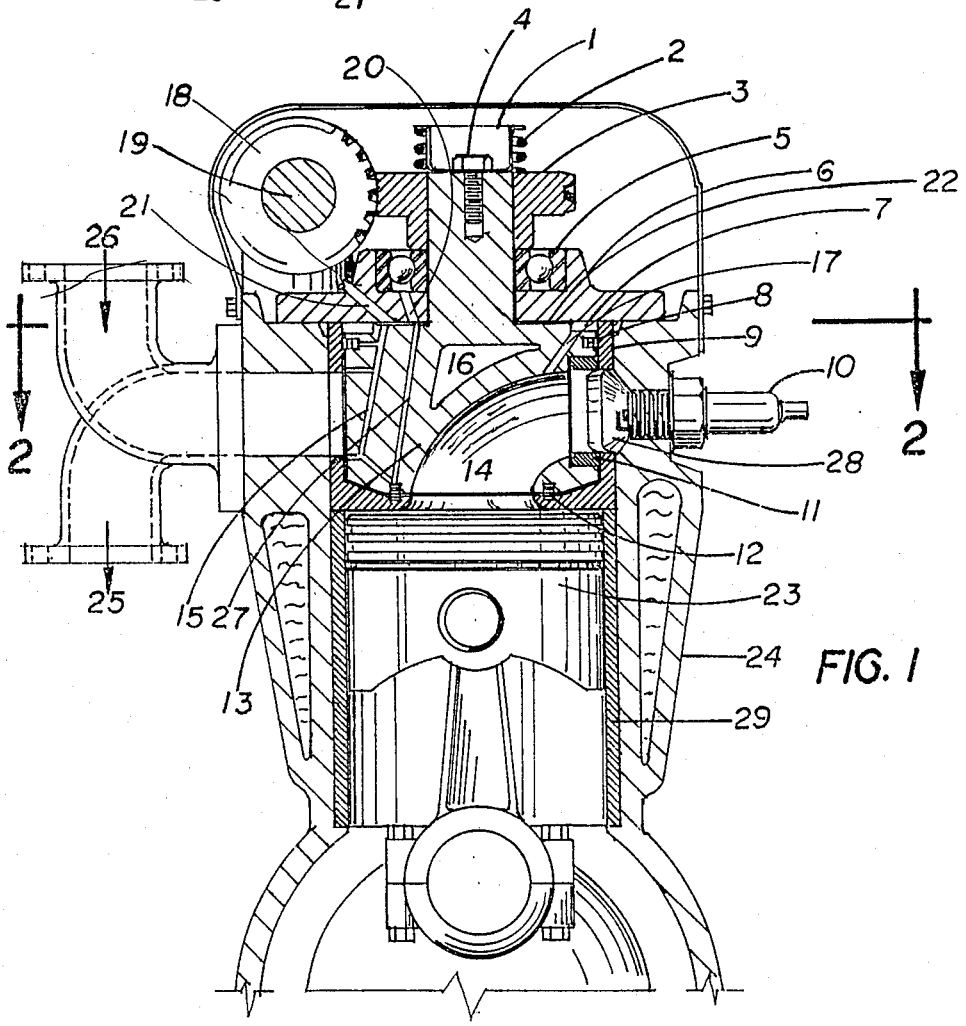
FIG. 1 is a vertical cross-sectional view through the cylinder of a four-cycle monoblock engine showing the valve apparatus positioned above the piston in accordance with the present invention.
Figure 3:
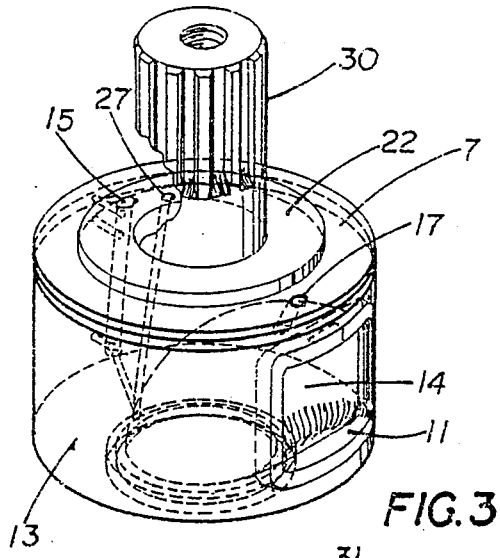
FIG. 3 is an isometric view of the valve body showing a splined drive shaft with a cut-out portion to expose the oil gallery openings on the boss area, the side aperture seal of the flow passage chamber, and the vent opening to the recessed area also shown are the compression ring grooves.
Figure 4:
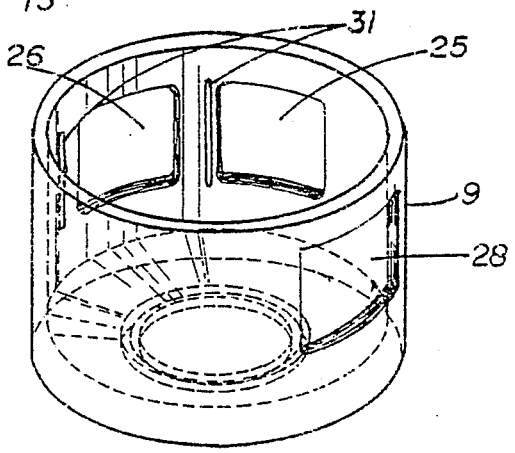
FIG. 4 is an isometric view of the valve cylinder liner in which the valve body rotates, showing the port openings exposing the spark-plug cavity and the exhaust and inlet ports.

It is apparent that this valve system is easily adaptable to conventional poppet-valve engines by fitting the engine with a head designed to use this rotary valve invention and bolting to the conventional engine block. As shown in FIG. 1, and FIG. 3, the rotating chamber 14, functions timely as a combustion chamber, and exhaust passage, and an intake passage. The sealing of said passage 14, from the combustion area above the piston is affected by the ring 12, and aperture sealing ring 11. The pressure in the combustion chamber varies cyclically with piston movement causing an oscillating force on the boss contact area of the valve body 13, with the valve cap plate 6. This problem is eliminated by introducing a vent passage 17, from the flow passage chamber 14, to the counterbalancing chamber 7, so designed to equalize pressure above and below the valve body 13. The volume of the counterbalancing chamber 7, is negligible compared to that of the total cylindrical volume and thus would not affect performance. Lubrication is provided through a pressurized gallery 21, in valve cap plate 6, open to boss area 22, registering with a gallery 15 through the valve body 13, with extention galleries to rings 8, and 12, and to surface of valve liner cylinder 9, in contact with aperture seal ring 11. A series of vertical oil grooves 31, placed as required between port openings allow disposal of lubrication to the sides of the aperture seal ring 11, as it rotates in the valve liner 9. The oil return gallery 27, serves as a pressure relief and oil flow gallery, vented through the valve cap plate 6. The oil galleries 20 and 21 in the valve cap 6, and 15 and 27 valve body 13, are in alignment once each revolution of the valve body 13. In FIG. 1, and FIG. 2, the flow passage chamber 14, is in registry with and exposed to the spark-plug 10. In this position, combustion is initiated as the flow passage chamber aperture rotates over the spark-plug cavity 28.

The combustion pressure produced impinges on the piston 23, forcing it to move downward, and simultaneously this pressure is transferred to chamber 7, through vent 17, thereby counterbalancing the upward force on the valve body 13, caused by combustion. As the piston 23, moves downward the flow passage chamber aperture 14, approaches the exhaust port aperture 25, and at bottom-dead-center the aperture 14, is in registry with the exhaust port 25. The spent charge is forced out of the combustion chamber through 14, as the piston moves upward. At top-dead-center the flow passage chamber aperture 14, approaches the intake port to begin ingesting the fuel-air mixture through port 26. The descending piston 23, draws in the charge as the flow passage chamber aperture 14, rotates over port 26, At bottom-dead-center the flow passage chamber aperture 14, has nearly past port 26, and as the piston commences the compression stroke the said flow passage chamber aperture 14, is sealed against the cylinder liner 9, until the piston 23, reaches top-dead-center and the flow passage chamber aperture 14, is again exposed to the spark-plug cavity 28, ready to be ignited by spark-plug 10. It is apparent that the rotary valve, as described, will provide an unrestricted flow of gases to and from the cylinder area and the rapidly rotating valve body will cause to stratify the fuel-air mixture to the perifery of the valve where the rich fuel-air mixture will be efficiently ignited by the spark-plug. In a similar manner, the spinning valve body will induce a slinging effect to the exhaust gases thereby allowing a more efficient purging of the spent gases. The momentary exposure of the spark-plug at ignition and subsequent shielding as the flow passage chamber aperture rotates over the spark-plug cavity eliminates overheating of the spark-plug tip, and thereby eliminats pre-detonation. The alternate heating and cooling of the flow passage chamber eliminates hot-spots formation in the combustion chamber, thereby eliminating another cause of pre-detonation.

It is further apparent that this invention can be used on any engine configuration, single to multi-cylinder, and on straight, V-type, and opposed design. It will be noted that in multi-cylinder engines adjacent counter-rotating valves will allow the use of common exhaust and intake ports per bank of two cylinders. Due to the large area of the valve body exposed to the valve liner which in turn is in contact with the head block, there is a large heat transfer from valve to the block which will reduce heat contained in the valve body.

Heat transfer to the valve body can be further reduced by applying a coating of ceramic, such as magnesium zirconate, on all surfaces exposed to combustion gases.

What is claimed is:

1. A rotary valve system for an internal combustion engine comprising:

a means for continuously rotating a valve body connected at a first axial end of said valve body;

a flow chamber within said valve body extending from a first aperture at a second axial end of said valve body through to a second aperture in a side of said body, said first aperture in fluid communication with a cylinder of said engine;

a valve cap through which extends said first axial end of said valve body, said valve cap contacting an upper end of said valve body and aligning said valve body withing the head of said engine;

means for substantially equalizing the pressure above said valve body with that in said cylinder during operation of said engine.

2. The valve system of claim 1 wherein said means for equalizing further comprises an equalizing chamber between said valve cap and said valve body in fluid communicatin with said cylinder through a vent in said valve body.

3. The valve system of claim 1 further comprising a valve liner assembly adapted to fit within said head of said engine and within which said valve body rotates, said liner having port apertures for affecting timely fluid communication with said flow chamber during rotation of said valve body during ignition, exhaust, and intake of fuel within said engine.

4. The valve system of claim 2 wherein said valve body further comprises a means for distributing lubrication to sealing rings which cooperate with said valve body and said liner to effectively seal said flow chamber during said operation of said engine.

5. The valve system of claim 3 wherein said valve cap further comprise a means for directing lubrication to said distribution means in said valve body.

6. The valve system of claim 4 wherein said sealing rings are stationary within said liner during rotation of said valve body.

* * * * *